US006810847B1

(12) United States Patent
Jefferson

(10) Patent No.: US 6,810,847 B1
(45) Date of Patent: Nov. 2, 2004

(54) CHARGE DISSIPATIVE COVER FOR SPARK PLUG, IGNITION WIRE AND BOOT

(76) Inventor: Ernest T. Jefferson, P.O. Box 215, Belhaven, NC (US) 27810

( * ) Notice: Subject to any disclaimer, the term of this patent is extended or adjusted under 35 U.S.C. 154(b) by 0 days.

(21) Appl. No.: 10/753,285

(22) Filed: Jan. 9, 2004

(51) Int. Cl.[7] ..... F02P 1/00
(52) U.S. Cl. ..... 123/169 P; 123/169 E
(58) Field of Search ..... 123/169 PA, 636, 123/146, 5 R, 169 E, 169 P; 439/125, 128

(56) References Cited

U.S. PATENT DOCUMENTS 4,497,532 A * 2/1985 Bezusko et al. ..... 439/485
4,671,586 A * 6/1987 DeBolt ..... 439/126
5,476,695 A * 12/1995 Okada et al. ..... 428/457
6,386,893 B2 * 5/2002 Reum et al. ..... 439/125

* cited by examiner

*Primary Examiner*—Bibhu Mohanty
(74) *Attorney, Agent, or Firm*—Mills Law Firm PLLC

(57) ABSTRACT

A charge dissipative cover for the spark plug boot and an ignition wire connected with spark plug of an engine includes a woven fiberglass sheath surrounding the spark plug insulator and spark plug boot and having an exterior coating comprising a silicone-based base coat containing aluminum flake and a dielectric silicone-based top coat containing ceramic pigment.

13 Claims, 3 Drawing Sheets

CHARGE DISSIPATIVE COVER FOR SPARK PLUG, IGNITION WIRE AND BOOT

FIELD OF THE INVENTION

The present invention relates to ignition wire shielding and, in particular, a dissipative cover for grounding spark plug ignition cable electrical charges.

BACKGROUND OF THE INVENTION

Ignition systems for automotive engines are conventionally provided with an elastomeric boot for covering and protecting the electrical connection between the ignition cable and the spark plug. As engine operating temperatures have increased over the years and as the cylinder heads were located closer to the exhaust manifolds, the temperatures to which the boot and spark plug are exposed have increased correspondingly. The high temperatures reduce the useful life of the boot elastomer, even when high temperature silicone products and protective lubricants are used. In addition, the high voltage ignition systems on current engines can create conditions exceeding the dielectric strength leading to external grounding that can cause further erosion of the boot as well as corrosion of the contact interfaces. It has further been determined that the ignition cables can create high potential gradients, with attendant high E-field intensities creating corona discharges that can further degrade the boots and contacts.

In an early approach, metal shields were used to surround the spark plug boot to shield against excessive heat as disclosed in U.S. Pat. No. 4,497,532 to Benzusko et al. and U.S. Pat. No. 4,671,586 to DeBolt. The shields, however, can provide an adverse grounding path when the dielectric strength is exceeded resulting in engine misfire and performance reduction. It has also been proposed to use high temperature ceramic sleeves to isolate the spark plug boot from high operating temperatures as disclosed in U.S. Pat. No. 6,305,954 to Aluise. The sleeves are rigid and difficult to mount on existing cables, and are limited to in-line boots, to the exclusion of commonplace inclined or right angle boot configurations. The ceramic material does not assist in dissipating electrical fields. It has also been proposed to reduce corona discharge by incorporating a conductive sleeve on the boot interior as disclosed in U.S. Pat. No. 5,716,223 to Phillips et al. All of the foregoing approaches are directed to original equipment limiting the ability to provide improved protection to existing as well as new engines.

It would accordingly be desireable to provide a universal design for ready integration with existing and new ignition cables to protect the boot and electrical connection from deterioration by increasing thermal and radiant insulation, and decreasing adverse electrical effects.

SUMMARY OF THE INVENTION

The present invention provides a flexible fabric cover for simple installation over the spark plug boot that is coated with a heat reflective electrical conductive base coat and a dielectric top coat to provide electric dissipation protection. The cover takes the form of currently available fiberglass sleeves having a restrictive mouth that fits over the spark-plug insulator and a sleeve body that covers the boot and connector area and extends therebeyond. The sleeve body has sufficient flexibility to accommodate in-line and angled boots. The base coat comprises a high temperature silicone resin containing electrically conductive aluminum flake that provides infrared reflectivity and a conductive exterior sheath with low break down voltage that dissipates static and corona charges to eliminate elastomer attack. The top coat includes a silicone resin containing a high temperature ceramic pigment effective for providing a dielectric outer coating and increasing thermal resistance. The top coat may include a color pigment for providing an appealing contrasting color to the basically gray/silver coloration of the standard sleeve material. The novel cover may be installed on existing high operating temperature engines to shield against electrical charges, extend life and function of the boot assembly, lower cable operating temperatures. The materials are porous and breathable to reduce heat buildup and reduce moisture retention, non-flammable and non-toxic, and not reactive with petroleum products. The flexible fabric construction allows the cover to be conveniently mounted in recessed plug ports.

Accordingly, it is an object of the present invention to provide an improved cover for protecting spark plug boot assemblies against thermal and electrical degradation.

Another object is to provide a flexible thermal and electrically protective cover for surface mounted and recessed port spark plug boots and connectors.

A further object is to provide a spark plug boot cover that dissipates static and corona charges to reduce degradation and operational impairment of spark plug boots and cable connections.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENT

Figure 1:
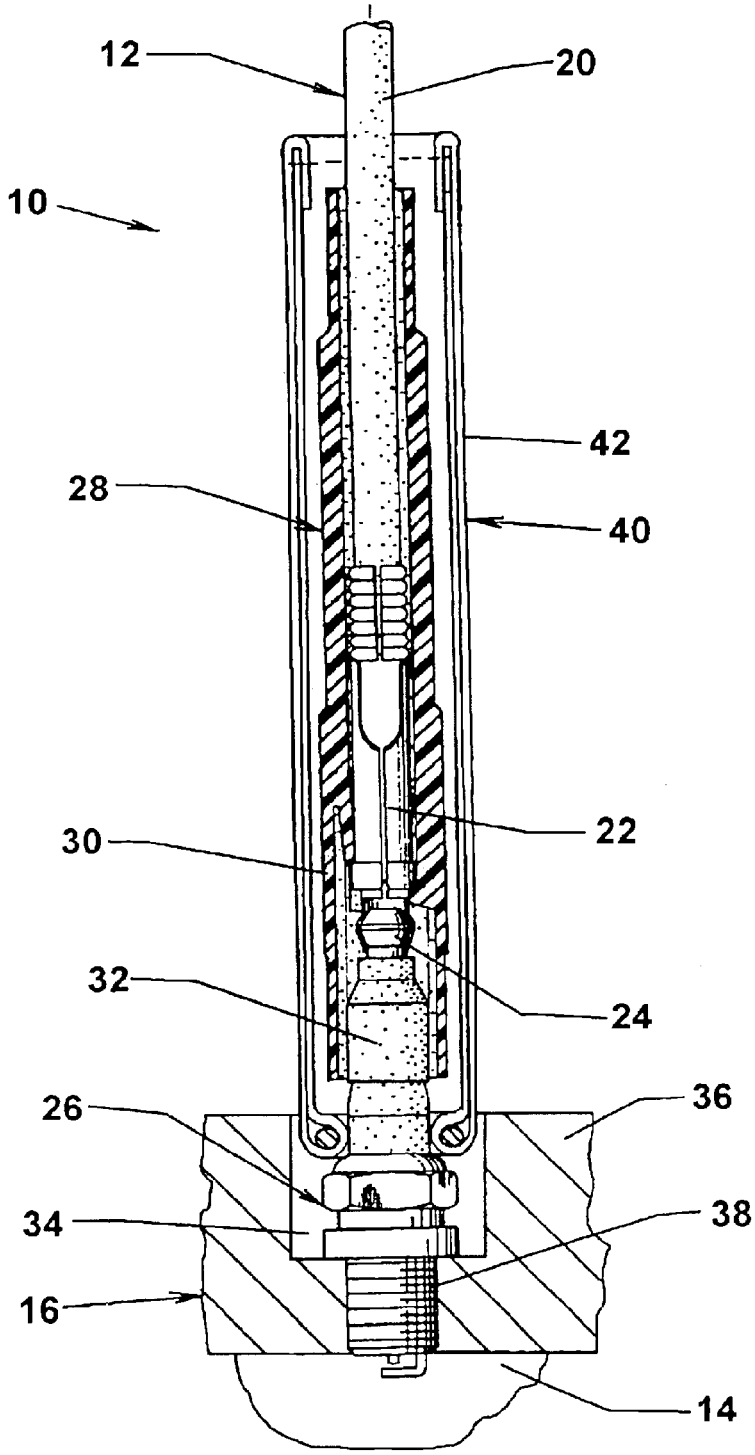
FIG. 1 is a side cross sectional view of a charge dissipative cover installed over a ignition line including an ignition cable, a spark plug boot and a spark plug.
Figure 2:
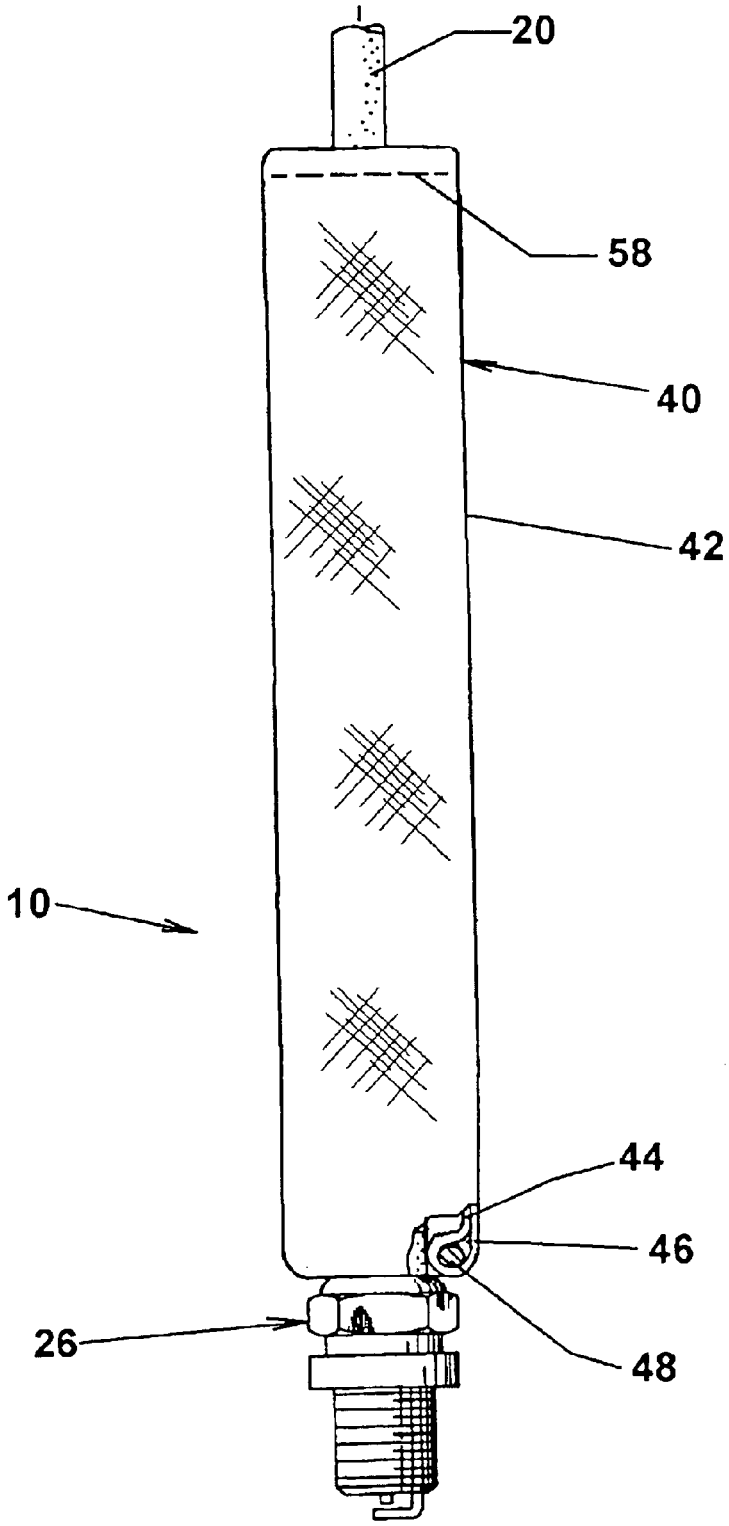
FIG. 2 is a side elevational view of the cover of FIG. 1 on the ignition line.

Referring to the drawings for the purpose of describing the preferred embodiments only and not for limiting same, FIGS. 1 and 2 show a charge dissipative cover 10 for the ignition line 12 for a combustion chamber 14 of an internal combustion engine 16. As conventional, the ignition line 12 includes an ignition cable 20 terminating with a socket terminal 22 attached to the stud terminal 24 of a spark plug 26. An elastomeric spark plug boot 28 is carried at an upper end on the ignition cable 20 and includes a lower skirt 30 having an interior socket engaging and sealing the spark plug insulator 32. The spark plug 26 is received in a recessed port 34 in the cylinder head 36 of the engine with a threaded shank 38 conventionally screwed into a threaded opening interfacing with the combustion chamber 14.

The ignition line components employed differ by engine, model and manufacturer. The cover as herein described finds application in the vast majority of engines designs for use as original or aftermarket equipment. The cover has sufficient flexibility for use with in-line as well as angular offset boots and cables.

The cover 10 overcomes the problems associated with high operating temperatures, high voltage, and static and corona charges. The cover 10 includes a tubular cover body 40 formed of a high temperature resistant braided fabric having a thermally insulating and electrically conductive coating system 42 on the outer surfaces thereof. The cover body 40 is preferably formed of braided fiberglass sleeving, preferably E-type glass. Suitable fabric is available as product no. 2F-120-18 from Atkins & Pearce, Inc. of Covington, Ky. A 1-inch inner diameter tube accommodates the majority of current ignition assembly configurations. Prior to assembly, the tubing is heat treated and annealed to remove resins and reduce fraying.

Figure 3:
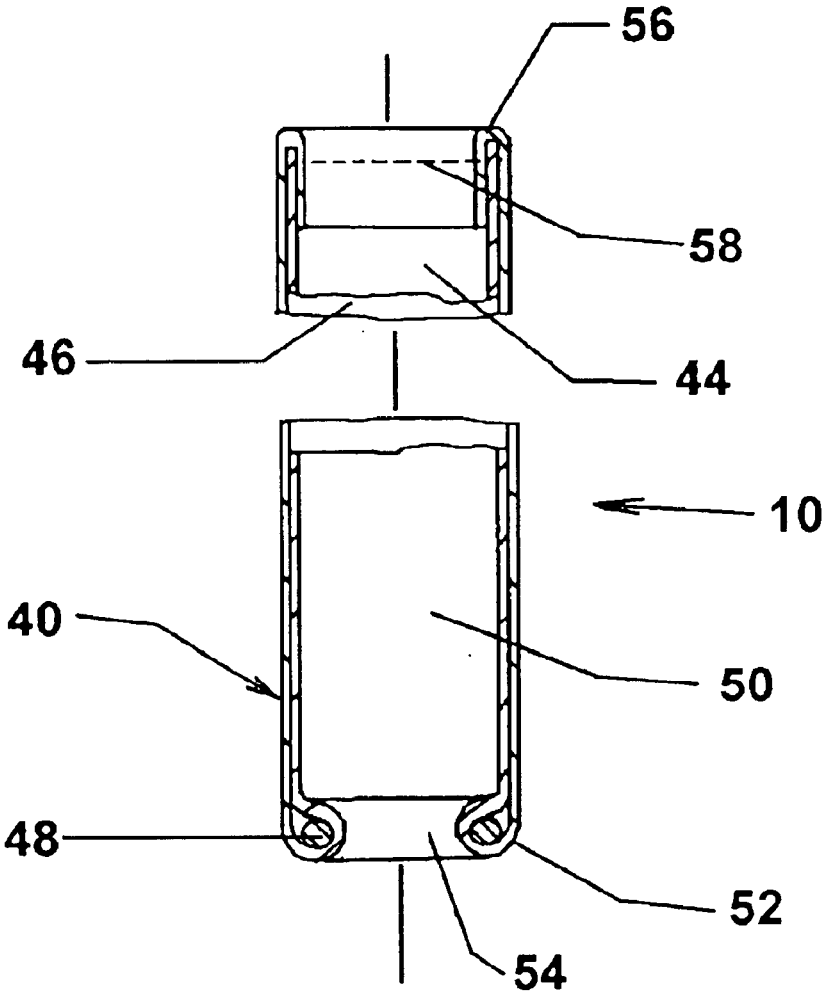
FIG. 3 is a sectioned side view of the cover of FIG. 1.

Referring to FIG. 3, the body 40 includes an inner layer 44 and an overlying outer layer 46 folded and gathered around a retaining ring 48 thereby defining a cylindrical upwardly opening socket 50 downwardly terminating with an inwardly curved annular mouth 52 having a coaxial circular port 54 establishing a sliding fit with the spark plug insulator 32. The upper end of the outer layer 46 is inwardly folded over the inner layer 44 at cylindrical hem 56. The upper ends of the layers and the hem 56 are interconnected at circumferential stitching 58.

Figure 4:
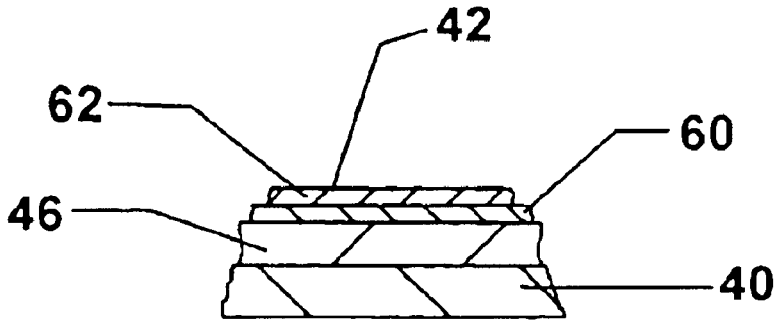
FIG. 4 is a fragmentary cross sectional view of the cover wall including the conductive base coat and dielectric top coat.

Referring to FIG. 4, the coating system 31 comprises an electrically conductive, heat reflective base coat 44 and a heat resistant, dielectric top coat 46. The base coat 44 comprises a sprayed silicone resin having a substantial portion of electrically conductive flake. The base coat 44 is characterized by a low breakdown voltage that functions to bleed static and corona charges under engine operating conditions. The base coat 44 is spray applied and ambiently dried to the touch without curing. Final curing takes place under engine operating conditions. Alternatively, the base coat 44 may be cured prior to use. The top coat 46 is spray coated over the dried base coat 44. The top coat 46 comprises a silicone resin containing an effective amount of high temperature ceramic material sufficient to provide infrared reflectivity and dielectric protection from external sources.

A suitable base coat formulation comprises a silicone component, in powder and/or liquid resin form, in a solvent and carrier base and containing an amount of metallic particulate, in flake or otherwise finely dispersible form, for providing the desired electrical characteristics in the base coat 44. Suitable catalysts and fillers may be added. The dried base coat contains about 15 to 35% metallic particulate based on weight, with 25 to 30% preferred. A preferred metallic particulate is aluminum flake having a particulate size of around 50 microns.

An effective formulation for the base coat is set forth below:

| Item | Vendor | Product No. | Amount (gr.) |
|---|---|---|---|
| Aluminum | | 552750 | 545 |
| Acetone | | | 1,135 |
| Xylene | | | 200 |
| Silicone Resin | | | |
| Powder | Seegott | SILREZ 604 | 1,360 |
| Liquid | Seegott | SY-409 | 130 |
| Talc | | | 27 |
| Catalyst | | | |
| Iron Hex | 6% | OMG | 7 |

The formula is prepared by mixing the acetone and xylene and gradually adding and dissolving the silicone powder. Thereafter the silicone liquid and aluminum flake are added and mixed thoroughly, the talc added and the catalyst slowly added and mixed. The mixture is blended sufficiently to avoid settling and transferred to a spray apparatus for application.

The top coat is based on the above formulation, with a suitable ceramic pigment substituted for the metallic particulate. For a red color, for example, a red ceramic pigment is used. A suitable pigment is available from General Color as product no. GR0660. Depending on the engine operating temperatures and proximity to the exhaust manifold, the ceramic content may be in the range of about 15% to 45% based on the weight of the silicone components.

The coating system 42 has been determined to provide both conductive and dielectric properties in covers using the above formulations. Covers containing only the base coat system have been tested in accordance with accepted protocols and were determined to have relatively low breakdown voltages of around 500 volts, well below that necessary for the effective grounding of the charges experienced in high voltage ignition systems. Covers containing the top coat withstood greater than 4,000 volts without any indications of breakdown, demonstrating substantial dielectric properties resisting outside interference.

While the present embodiment has been described with reference to the preferred embodiments, other modifications and changes thereto will become apparent. Accordingly, the invention is to be interpreted solely with reference to the following claims.

What is claimed:

1. In an engine having a spark plug with an insulator including a terminal connected with an ignition wire and an elastomeric boot covering the insulator, the terminal and the adjacent ignition wire, a charge dissipative cover for protecting against corona and static charges comprising: a tubular sheath of woven fiberglass strands having an interior socket for receiving said insulator and said boot, said socket having a constricted mouth at a lower end for engaging said insulator and an open upper end for receiving said ignition wire; a coating system adhered to at least the outer surface of said sheath and comprising a first layer adhered to said outer surface and a second layer adhered to said first layer, said first layer comprising a silicone-based coating containing by weight of said first coat about 15 to 35 percent aluminum flake having a particle size establishing electrical conductivity in said first coat at a low break down voltage, said second layer including ceramic pigment in an amount providing thermal resistance for said sheath and a dielectric resistance for said second layer.

2. A protective cover for the spark plug boot connected with an ignition wire and spark plug of an engine, comprising: a single length of woven glass tubular sleeve having an inner layer and an outer layer gathered at one end around a circular retainer ring and forming a restricted mouth with a lower opening, said mouth being slidably received over the insulator of said spark plug, the other ends of said inner layer and said outer layer forming an upper opening of a pocket extending between said lower opening and said upper opening, said pocket receiving said spark plug boot and adjacent ignition wire; a coating system on said outer layer including a silicone-based base coat containing metallic particulate in sufficient quantity to make said base coat conductive for grounding static and corona charges in said ignition wire.

3. The cover as recited in claim 2 wherein said metallic particulate is aluminum flake.

4. The cover as recited in claim 3 wherein said aluminum flake has a particle size providing a low break down voltage in said base coat.

5. The cover as recited in claim 4 wherein said aluminum flake has a particle size of around 50 microns.

6. The cover as recited in claim 5 wherein said aluminum flake is about 15 to 35% by weight of said base coat.

7. The cover as recited in claim 6 wherein said aluminum flake is about 25 to 30% by weight of said base coat.

8. The cover as recited in claim 3 including a topcoat overlying said base coat and containing refractive particles providing dielectric and thermal resistance properties to said top coat dielectric.

9. The cover as recited in claim 8 wherein said refractive particles are ceramic pigments.

10. The cover as recited in claim 9 wherein said ceramic pigments provide a contrasting coloration to said base coat.

11. The cover as recited in claim 9 wherein said ceramic pigments provide infrared reflectivity to said top coat.

12. The cover as recited in claim 11 wherein said ceramic pigments comprise about 10 to 45% by weight of said top coat.

13. The cover as recited in claim 11 wherein said spark plug is carried in a recessed port in said engine and said mouth of said sleeve is smaller than said port for reception therein.

* * * * *